US011039655B2

(12) United States Patent
Polegato Moretti et al.

(10) Patent No.: US 11,039,655 B2
(45) Date of Patent: Jun. 22, 2021

(54) BREATHABLE SHOE

(71) Applicant: GEOX S.P.A., Frazione Biadene (IT)

(72) Inventors: Mario Polegato Moretti, Crocetta del Montello (IT); Livio Poloni, Caerano di San Marco (IT); Mirco Bergamin, Castelfranco Veneto (IT)

(73) Assignee: GEOX S.P.A., Frazione Biadene (IT)

( * ) Notice: Subject to any disclaimer, the term of this patent is extended or adjusted under 35 U.S.C. 154(b) by 474 days.

(21) Appl. No.: 15/757,776

(22) PCT Filed: Sep. 5, 2016

(86) PCT No.: PCT/EP2016/070862
§ 371 (c)(1),
(2) Date: Mar. 6, 2018

(87) PCT Pub. No.: WO2017/042127
PCT Pub. Date: Mar. 16, 2017

(65) Prior Publication Data

US 2020/0229534 A1 Jul. 23, 2020

(30) Foreign Application Priority Data

Sep. 7, 2015 (IT) ..... IT102015048836

(51) Int. Cl.
*A43B 13/12* (2006.01)
*A43B 7/12* (2006.01)
(Continued)

(52) U.S. Cl.
CPC ..... *A43B 7/125* (2013.01); *A43B 13/125* (2013.01); *A43B 13/32* (2013.01); *A43B 23/022* (2013.01); *A43B 13/386* (2013.01); *A43B 17/107* (2013.01)

(58) Field of Classification Search
CPC ..... A43B 7/125; A43B 13/125; A43B 13/32; A43B 13/386; A43B 23/022; A43B 17/107
See application file for complete search history.

(56) References Cited

U.S. PATENT DOCUMENTS 4,970,807 A * 11/1990 Anderie ..... A43B 13/181 36/28
5,150,490 A * 9/1992 Busch ..... A43B 17/14 12/146 M
(Continued)

FOREIGN PATENT DOCUMENTS

EP 2767181 A1 8/2014
EP 2767183 A1 8/2014
(Continued)

OTHER PUBLICATIONS

International Search Report dated Nov. 15, 2016, in PCT/EP2016/070862, filed Sep. 5, 2016.
(Continued)

*Primary Examiner* — Ted Kavanaugh
(74) *Attorney, Agent, or Firm* — Oblon, McClelland, Maier & Neustadt, L.L.P.

(57) ABSTRACT

A breathable shoe, including an outsole arranged below a structural insert that is at least partially breathable, and below an upper. The outsole is at least partially breathable, including at least one sheet-like breathable element defined by a plurality of granules made of expanded material and having a uniform size, arranged in a substantially ordered manner and between which there are voids that form one or more channels through the breathable element that are permeable to air and/or vapor.

15 Claims, 6 Drawing Sheets

(51) Int. Cl.

| | |
|---|---|
| ***A43B 13/32*** | (2006.01) |
| ***A43B 23/02*** | (2006.01) |
| *A43B 13/38* | (2006.01) |
| *A43B 17/10* | (2006.01) |

(56) References Cited

U.S. PATENT DOCUMENTS

| | | | | |
|---|---|---|---|---|
| 2006/0026863 | A1* | 2/2006 | Liu | A43B 13/16 36/25 R |
| 2007/0271815 | A1 | 11/2007 | Moretti et al. | |
| 2009/0172971 | A1 | 7/2009 | Peikert et al. | |
| 2013/0091738 | A1 | 4/2013 | Peikert et al. | |
| 2013/0097891 | A1 | 4/2013 | Moretti M et al. | |
| 2013/0152430 | A1* | 6/2013 | Bier | A43B 7/125 36/3 A |
| 2013/0291409 | A1* | 11/2013 | Reinhardt | A43B 5/00 36/30 R |
| 2014/0223776 | A1* | 8/2014 | Wardlaw | A43B 13/187 36/102 |
| 2014/0223783 | A1 | 8/2014 | Wardlaw et al. | |
| 2015/0237953 | A1 | 8/2015 | Moretti M et al. | |
| 2016/0007675 | A1 | 1/2016 | Bier et al. | |
| 2016/0235153 | A1 | 8/2016 | Peikert et al. | |

FOREIGN PATENT DOCUMENTS

| | | | |
|---|---|---|---|
| WO | 2005/063069 | A2 | 7/2005 |
| WO | 2007/101625 | A1 | 9/2007 |
| WO | 2012/028207 | A1 | 3/2012 |

OTHER PUBLICATIONS

Italian Search Report dated May 11, 2016, in IT 102015000048836, filed Sep. 7, 2015.

* cited by examiner

BREATHABLE SHOE

The present invention relates to a breathable shoe.

As is known, for a shoe to be comfortable it is necessary to ensure correct anatomical fit and at the same time at least correct outward permeation of the water vapor that can form inside the shoe due to the sweating of the foot.

The term "breathable" is understood to reference the ability of a material or an item to be crossed by humid air and more particularly, for a shoe, the ability to expel outward the water vapor that forms inside it due to foot sweating.

The part of the foot that is usually most subject to sweating is the sole. The sweat saturates the internal environment of the shoe and mostly condenses, stagnating on the insole.

For this reason, shoes are widespread which are provided with a perforated elastomer outsole on which a membrane which is permeable to water vapor and impermeable to water is sealed so as to cover its through openings.

However, the limited mechanical strength that usually characterizes these membranes leads to the penetration of foreign items, which enter through the holes of the outsole which the membrane faces.

This problem is often solved by coupling below the membrane protective layers, such as for example a support made of felt or other diffusely perforated material.

However, these protective layers reduce the vapor permeation of the membrane and stiffen the structure in addition to increasing its weight, reducing its level of comfort.

Furthermore, other drawbacks of shoes with an outsole made of perforated elastomer and a membrane reside in that they are unable to ensure the correct level of thermal insulation in countries characterized by cold climates, and also in that they are more sensitive to mechanical stresses caused for example by contact with the ground.

In order to obviate these drawbacks, various solutions of shoes the outsoles of which are at least partly made of expanded materials have been devised.

The use of expanded materials in the provision of components for shoes has been known for a long time and ethylene vinyl acetate (EVA), expanded thermoplastic polyurethane (e-TPU), expanded polystyrene (EPS), and expanded polyurethane (PU), are to be noted among the materials that are commonly used.

Among these materials, e-TPU has a low weight and good flexing and shock absorbing properties with respect to the others.

An example of these uses is given in U.S. Pat. No. 5,150,490, which discloses a shock absorbing or padding outsole element which comprises a plurality of randomly arranged granules of expanded material, which have a closed surface, are impermeable to air, with voids inside them and between the granules. This element is obtained by inserting in a mold the already expanded granules and by subsequent heating and/or pressurization.

EP2767181 discloses an outsole which comprises a mid-sole, which in turn comprises granules of expanded material which are arranged randomly and an element that has a higher deformation rigidity in at least one direction than the expanded material and is at least partly surrounded by the material of the mid-sole.

According to the teachings disclosed in EP2649896, an outsole for a shoe comprises a first surface region and a second surface region, in which the first one comprises an expanded thermoplastic polyurethane and the second one lacks it.

The same document claims an insole which comprises expanded thermoplastic polyurethane and a method for providing an outsole of a shoe, which comprises: loading a mold with an expanded thermoplastic polyurethane for a first surface region, loading the mold with a material that lacks expanded thermoplastic polyurethane for a second surface region and feeding steam for the expanded thermoplastic polyurethane.

EP2736967 discloses a method for manufacturing an outsole or a portion of outsole which consists in producing elements made of expanded thermoplastic urethane elastomer (TPU, e-TPU, TPE-U) and/or on the basis of polyether amide blocks (PEBA), in introducing the elements in a mold that has a cavity that corresponds to the shape of the outsole or outsole portion to be produced, and in connecting such elements in the mold to each other, by inserting a bonding agent in the mold and/or by using the heat of the pressurized steam.

In the shoe field, a drawback that can be observed in the use of elements made of expanded material that are known in the background art is their low breathability.

In view of what was explained initially, this can limit considerably the overall comfort of the shoe, since it leads to an increase in the forming of sweat or to an accumulation of heat, and can become problematic in particular when the product is worn continuously and for long times, such as for example in winter periods.

EP2767183 discloses how to overcome the limitations of the low breathability of expanded materials. According to its teachings, granules of expanded material are arranged randomly inside a mold, where they are subjected to heating and/or pressurization and/or steam, in order to provide a shock-absorbing element.

The granules of expanded material can have cross-sections of various kinds (annular, oval, square, polygonal, round, rectangular, star-shaped) and there are voids in the granules and/or between the granules: these voids form one or more channels which are permeable to air and/or to liquids.

The shock-absorbing element can comprise a sheet-like reinforcement element embedded therein.

The use of such an expanded material is particularly advantageous, since by way of the voids in the granules and/or between them the products that are manufactured with it acquire lightness and at the same time excellent shock-absorbing properties.

The shape and size of the granules, as well as the arrangement and shape of the voids between such granules and/or inside them, can influence the density of the element that they compose. This can affect the weight, thermal insulation and breathability of the element. The resulting element is in fact substantially breathable, but the random arrangement of the granules does not allow to obtain a clearly defined channel system, preventing a uniform transit of air through such element.

According to an ordered and uniform arrangement of granules, their succession repeats periodically, in one or more directions along the part, while according to the cited solution the granules are arranged randomly, since they are inserted in a mold and are subjected therein to heating and/or pressurization and/or steam. In this manner there is no possibility to predetermine the arrangement of the granules and therefore the transit of air through the element.

Furthermore, the use of a mold in the production of such element requires significant investments, due to the provision of such mold.

The aim of the present invention is to provide a breathable shoe that is capable of obviating the drawbacks cited above, ensuring adequate levels of comfort for the user.

Within this aim, an object of the invention is to contain the production costs of a shoe provided with a breathable element that comprises granules made of expanded material.

This aim, as well as these and other objects that will become better apparent hereinafter, are achieved by a breathable shoe, comprising an outsole arranged below a structural insert that is at least partially breathable, and below an upper, said shoe being characterized in that said outsole is at least partially breathable, comprising at least one sheet-like breathable element formed by a plurality of granules made of expanded material and having a uniform size, arranged in a substantially ordered manner and between which there are voids that form one or more channels through said breathable element which are permeable to air and/or vapor.

Further characteristics and advantages of the invention will become better apparent from the description of three preferred but not exclusive embodiments of the shoe according to the invention, illustrated by way of nonlimiting example in the accompanying drawings, wherein.

Figure 1:
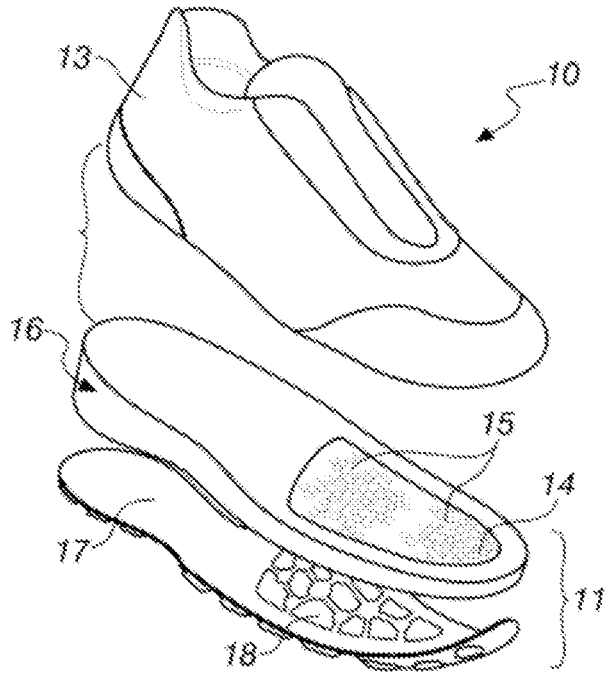
FIG. 1 is a partially exploded perspective view of a shoe according to the invention in a first embodiment.

With reference to FIGS. 1 to 4, the shoe according to the invention, in its first embodiment, is designated generally by the reference numeral 10.

It comprises an outsole 11 that is arranged below a structural insert 12, which is at least partially breathable, and below an upper 13.

The outsole 11 is at least partially breathable, comprising a sheet-like breathable element 14 that is defined by a plurality of granules 15 made of expanded material and having a uniform size, which are arranged in a substantially ordered manner and between which there are voids that form one or more channels through the breathable element 14 which are permeable to air and/or vapor.

The granules 15 of the breathable element 14 are bonded by means of an adhesive, a water-based polyurethane glue which is thermoplastic or thermosetting and preferably biodegradable and/or recyclable. The glue, by wrapping around the granules, allows their adhesion, leaving gaps between them. The gaps are mutually connected, creating the channels for the transit of air.

The arrangement of the granules 15 is ordered when their succession repeats periodically, in one or more directions, along the part. In particular, arrangements that are known from crystalline lattices of metals, salts and minerals are preferred. Furthermore, since the granules 15 have a uniform size, they are arranged in an ordered manner at least as regards the planes that contain them. They have a substantially spherical shape, facilitating an at least almost ideal arrangement of the particles, like the hexagonal or cubic packing in metals.

FIGS. 12 to 15 show some constructive variations of the breathable element 14.

Figure 12:
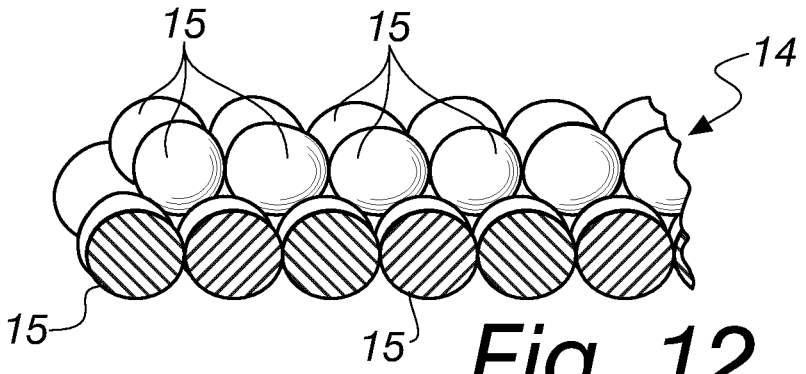
FIG. 12 is a sectional view of a portion of a breathable element.

In particular, FIG. 12 shows an example according to which the breathable element 14 is composed of two planes of granules 15. The granules 15 of one plane are arranged substantially at the hollows between the granules 15 of the other plane.

Figure 13:
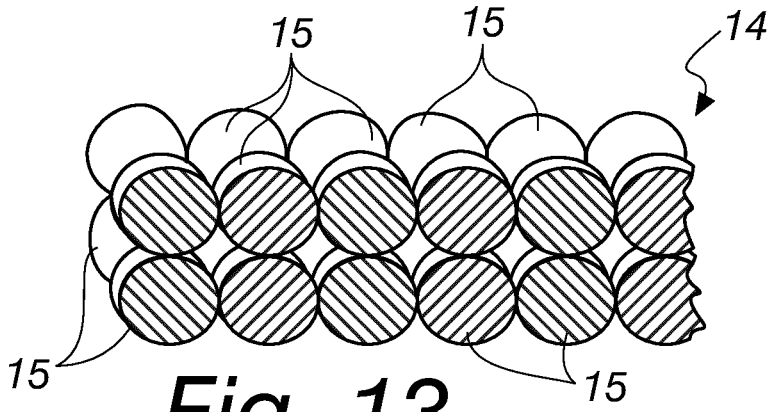
FIG. 13 is a sectional view of a portion of another breathable element.

In the example of FIG. 13, differently from the preceding one, the granules 15 of one plane are substantially superimposed on those of the other plane.

Figure 14:
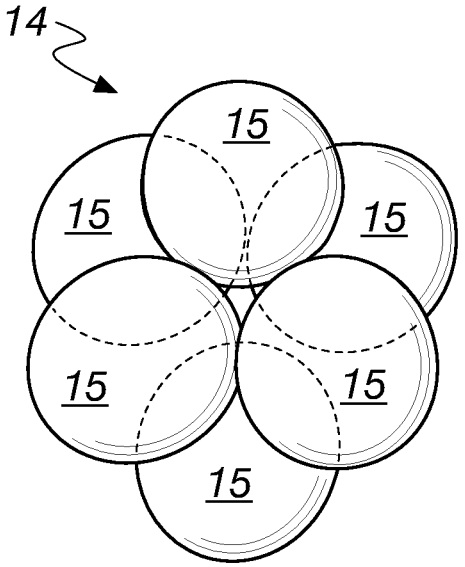
FIG. 14 is a perspective view of a portion of a breathable element, in a constructive variation thereof.

FIG. 14 shows a portion of a breathable element 14 in another variation thereof which shows the arrangement of the granules 15 that is adapted to repeat itself in constituting the breathable element 14. The breathable element portion 14 comprises four granules 15, at the center of which two other granules 15 are arranged, each on opposite sides of the plane that can be defined with the four preceding ones.

Figure 15:
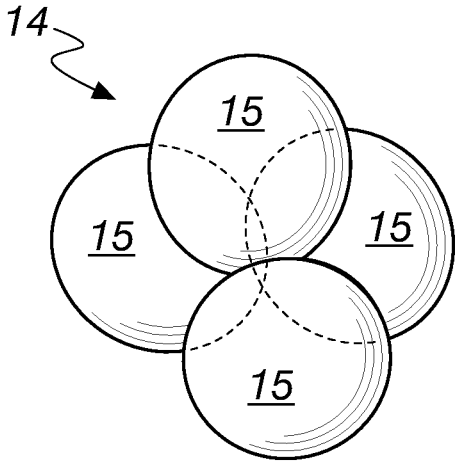
FIG. 15 is a perspective view of a portion of a breathable element, in another constructive variation.

FIG. 15 shows a portion of a further variation of a breathable element 14, which also shows the arrangement of the granules 15 that is adapted to repeat itself in constituting the breathable element 14. The portion of breathable element 14 comprises three granules 15, at the center of which there is a fourth granule 15, substantially on another plane with respect to the one that can be defined with the three preceding ones.

In all the illustrated variations of the shoe 10, the outsole 11 comprises a midsole 16 that has a through opening in the plantar region, occupied by the breathable element 14, on which the structural insert 12 is superimposed, and also comprises a tread 17 for contact with the ground which is associated in a downward region with the midsole 16 so as to partially cover the breathable element 14, being provided with through openings 18 at least thereat.

The through openings 18 connect the channels of the breathable element 14 to the outside environment. In this manner, the humid air that arrives from the inside of the shoe 10 passes in succession through the structural insert 12, through the channels of the breathable element 14 and reaches the outside through the through openings 18.

The structural insert 12 is shown in the sectional views of a portion of shoe 10, which show three different variations thereof.

Figure 2:
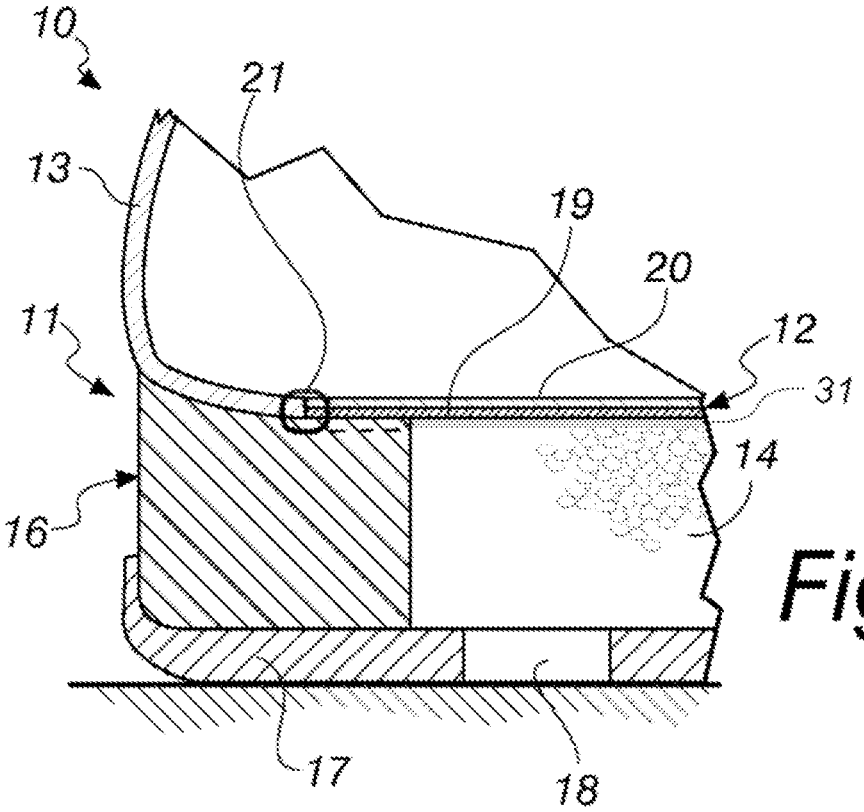
FIG. 2 is a sectional view of a portion of the shoe according to the invention in the first embodiment.
Figure 3:
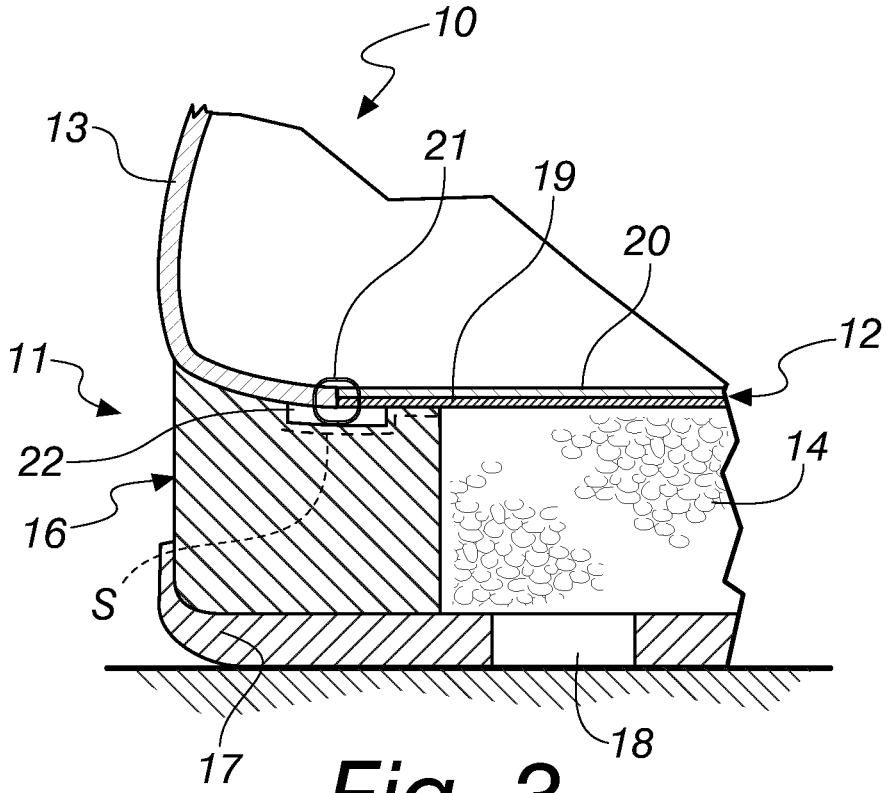
FIG. 3 is a sectional view of a portion of the shoe according to the invention in a variation of the first embodiment.

Such insert, in the first two variations shown respectively in FIG. 2 and in FIG. 3, constitutes with the upper 13, to which it is joined perimetrically, an upper assembly to be associated in an upper region with the outsole 11 and in all the variations has a surface extent that at least corresponds to the extent of the breathable element 14, on which it is superimposed.

As visible in the sectional figures, the structural insert 12 comprises, in each variation, a waterproof and breathable functional layer 19 that is arranged above the breathable element 14.

The structural insert 12 can be constituted exclusively by the functional layer 19 or, as in the illustrated variations, another element, preferably an insole 20, can be coupled to the functional layer 19, as indicated in FIGS. 2 and 3.

Such layer is provided by die-cutting from a sheet or a roll of the same material, which is for example constituted by a membrane, of the type made of microporous expanded polytetrafluoroethylene (e-PTFE) and/or of polyurethane, polyethylene, polypropylene, polyester or the like, with thicknesses that vary in general from 15 to 70 microns, is impermeable to water and permeable to water vapor, and preferably laminated with at least one supporting mesh (not shown) made of plastic material.

As an alternative to the membrane, the functional layer 19 can comprise an insert with a layered and cohesive monolithic sheet-like structure, which comprises a plurality of waterproof and breathable functional layers made of a polymeric material that is impermeable to water and permeable to water vapor, such as the one disclosed in EPA no. 09425334.1 dated 28 Aug. 2009 by the same Applicant, or an insert having a monolithic sheet-like structure, made of a polymeric material that is impermeable to water and permeable to water vapor, such as the one disclosed in EPA no. 09425336.6 dated 28 Aug. 2009 by the same Applicant.

According to the first variation shown in FIG. 2, the structural insert 12 is joined to the upper 13 by means of a stitched seam 21 of the Strobel type, which is known per se. The upper assembly is joined to the outsole by means of adhesives of a known type. In particular, the functional layer 19 is joined hermetically, in a manner that is impermeable to liquids, to the upper surface of the midsole 16, for a width that is indicated by the reference S and shown in broken lines and can vary preferably between 5 mm and 10 mm.

As an alternative, the hermetic joint can be obtained by direct injection of the midsole on the upper.

As shown with the variation of FIG. 3, it is possible to seal the functional layer 19 to the upper 13, at the stitched seam 21, by means of a thermo-adhesive waterproof tape 22, substantially a film of thermoplastic hot-melt adhesive, made of polyurethane, polyester, polyamide or polyolefins that can be activated by subjecting it to heat and pressure. This film, heated and subjected to pressing, softens and penetrates the permeable substrates to be sealed onto which it is pressed. Subsequently, by cooling, it establishes a connection by adhesive bonding, of a mechanical and chemical type with these substrates and reacquires its original strength.

The tape 22 is arranged so as to straddle the joint between the upper 13 and the functional layer 19, so as to be sealed to both.

The upper assembly is joined to the outsole by means of adhesives of a known type. In particular, the functional layer 19 and in this case also the tape 22 are joined hermetically to the upper surface of the midsole 16, for a width that is indicated by the reference S and shown in broken lines and can vary preferably between 10 mm and 15 mm.

Figure 4:
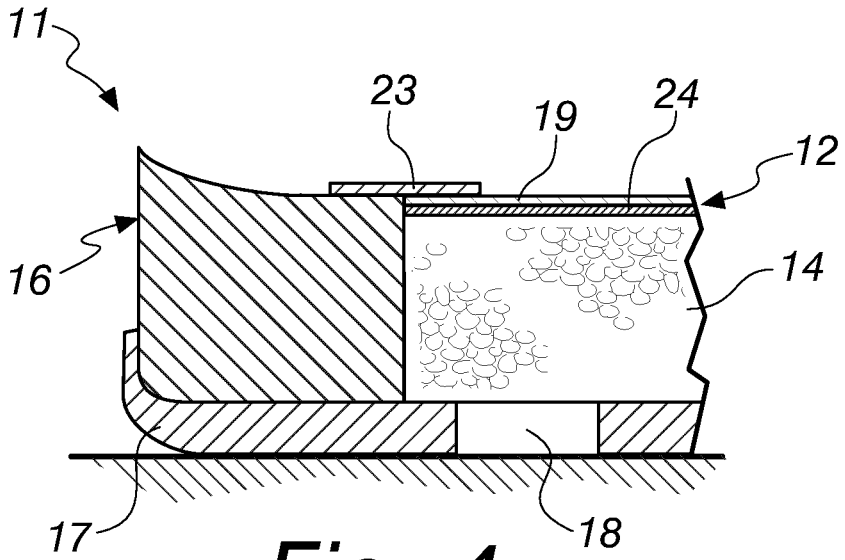
FIG. 4 is a sectional view of a portion of the shoe according to the invention in another variation of the first embodiment.

In the third variation shown in FIG. 4, the upper is not joined to the structural insert 12. The functional layer 19 is joined hermetically to the upper surface of the midsole 16. It is in fact sealed from the upper side to the midsole 16 by means of a ring 23 made of waterproof material (for example PVC), which is applied in a bridge-like manner between the two elements.

In this case, the functional layer 19 is coupled to a protective layer 24, which is arranged in a lower region, for example by spot gluing, with an adhesive of a known type that is resistant to hydrolysis. The protective layer 24 is made of a material that is resistant to penetration, breathable and capable of drying rapidly in a short time, constituted for example by a laminated fabric composed of polyester and polyamide.

Figure 5:
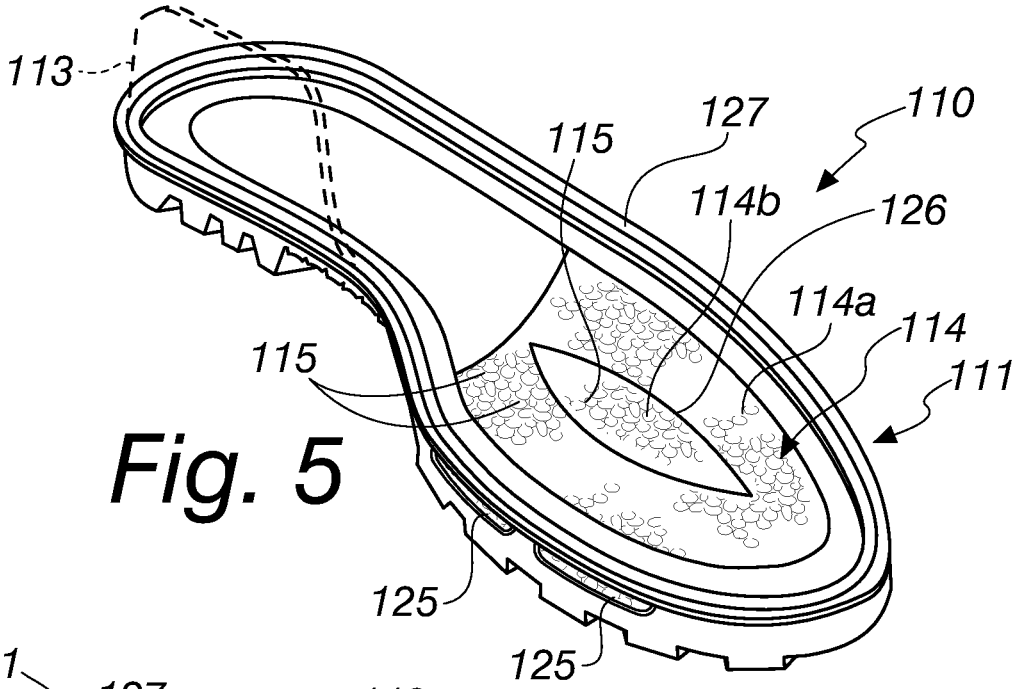
FIG. 5 is a perspective view of a portion of a shoe according to the invention in a second embodiment.
Figure 6:
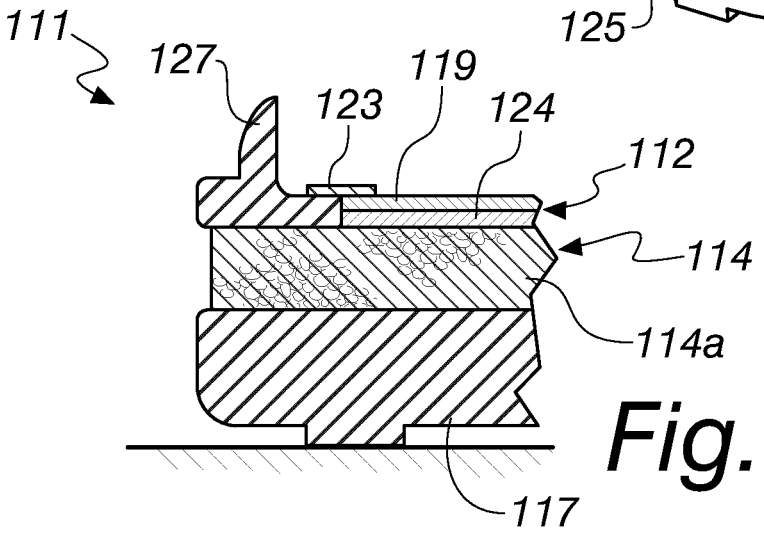
FIG. 6 is a sectional view of a portion of the shoe according to the invention in the second embodiment.
Figure 7:
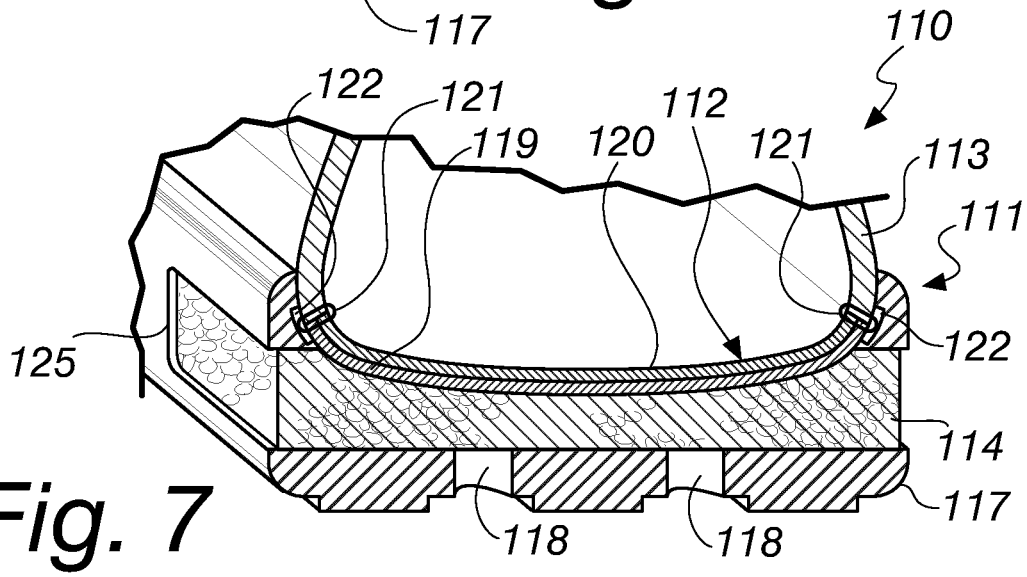
FIG. 7 is a sectional view of a portion of the shoe according to the invention in a variation of the second embodiment.

FIGS. 5 to 7 show a second embodiment of the shoe according to the invention, designated generally by the reference numeral 110.

It comprises an outsole 111 that is arranged below a structural insert 112, which is at least partially breathable, and below an upper 113.

The outsole 111 is at least partially breathable, comprising a sheet-like breathable element 114 that is defined by a plurality of granules 115 made of expanded material and having a uniform size, which are arranged in a substantially ordered manner and between which there are voids which form one or more channels through the breathable element 114 which are permeable to air and/or vapor.

The granules 115 of the breathable element 114 are bonded by means of an adhesive, a water-based polyurethane glue, which is thermoplastic or thermosetting and preferably biodegradable and/or recyclable. The glue, by wrapping around the granules, allows their adhesion, leaving gaps between them. The gaps are mutually connected, creating the air transit channels.

The arrangement of the granules 115 is ordered when their succession repeats periodically, in one or more directions, along the part. In particular, arrangements known from crystalline lattices of metals, salts and minerals are preferred. Furthermore, since the granules 115 have a uniform size, they are arranged in an ordered manner at least with respect to the planes that contain them. They have a substantially spherical shape, facilitating an at least almost ideal arrangement of the particles, such as the hexagonal or cubic packing in metals.

In this embodiment also, it is possible to use a breathable element in the variations shown in FIGS. 12 to 15 for the breathable element 14.

Two variations of the shoe 110 are shown in the figures cited for this embodiment.

According to this embodiment, the outsole 111 has a cavity in the plantar region, which is occupied by a breathable element 114, on which the structural insert 112 is superimposed, and lateral openings 125, on the sides of the shoe 110 at the region where the breathable element 114 is present, the forefoot in the illustrated case. Conveniently, the breathable element 114 is arranged in a recessed position with respect to the side walls of the outsole 111.

In FIG. 5, the outsole 110 lacks the structural insert 112, which is instead shown and indicated in the subsequent FIG. 6, in order to make the breathable element 114 visible.

The lateral openings 125 connect the channels of the breathable element 114 to the outside environment. In this manner, the humid air that arrives from the inside of the shoe 110 passes in succession through the structural insert 112, through the channels of the breathable element 114, and reaches the outside through the lateral openings 125.

The outsole 111 also comprises a tread 117 for contact with the ground, so as to cover at least partially the breathable element 114.

According to this embodiment, in the variation shown in FIG. 5 and in FIG. 6, the breathable element 114 is provided in two portions: a first breathable element portion 114*a*, which has at least one slit 126 that is provided substantially in the longitudinal direction of the shoe 110 and preferably in a central position with respect to the width of the latter, and a second breathable element portion 114*b*, which, when inserted in the slit 126, widens it, occupying the space thereof comprised between its walls.

The second breathable element portion 114*b* can be conveniently chosen with such dimensions as to widen the slit 126, modifying the external perimeter of the first breathable element portion 114*a* according to the dimensions that are sought.

Substantially, the shape of the breathable element 114 can be adapted, by varying appropriately the dimensions of the slit 126, to different curvatures of the side walls of the outsole 111, thus containing the number of die-cutters or molds needed to obtain the breathable element. Furthermore, this structure allows to avoid a further shaping, for example by roughing, of the side walls of the breathable element, which might cause the separation of some granules and which accordingly might increase rejects.

The two portions are preferably and not exclusively made of the same material; furthermore, the second portion 114*b* can be provided in a continuous form, as shown, or in the form of strips that are appropriately mutually spaced.

In this embodiment, the outsole 111 is provided with a welt 127, which is extended along its entire perimeter.

FIG. 6 shows a sectional view of the shoe 110, taken at the lateral opening 125, which shows the structural insert 112.

As can be seen, the structural insert 112 is arranged within the internal perimeter defined by the welt 127.

It comprises a waterproof and breathable functional layer 119 that is arranged above the breathable element 114. The functional layer 119 can be of the same type described for the preceding embodiment. In this manner, the humid air that arrives from the inside of the shoe passes through the functional layer 119 and then passes through the channels of the breathable element 114 to be expelled outside.

The structural insert 112 can be constituted exclusively by the functional layer 119 or, as shown in FIG. 6, it can be coupled to a protective layer 124 that is arranged in a lower region, for example by spot gluing, with an adhesive of a known type that is resistant to hydrolysis. The protective layer 124 is made of a material that is resistant to penetration, breathable and capable of drying in a short time, constituted for example by a laminated fabric composed of polyester and polyamide.

The functional layer 119 is joined hermetically, on the upper side, to the outsole 111, in particular to the upper surface of the latter, by means of a ring 123 of waterproof material (for example PVC) that is applied like a bridge between the two elements.

The upper 113 can be associated with the outsole 111 according to the methods that are common in the background art, for example by AGO, Strobel, tubular, moccasin, Ideal assembly.

In a variation shown with the sectional view of FIG. 7, the shoe 110 according to the invention has a breathable element 114 constituted by a one-piece body which faces the sides of the shoe 110 from the lateral openings 125. The pairs of lateral openings 125 provide substantially horizontal through openings.

The tread 117 is provided with through openings 118, which can be present also in the preceding variation. In this manner the humid air is free to escape outside through the bottom of the outsole 111 as well.

As shown, the structural insert 112, which in this case is structured like an assembly insole, constitutes with the upper 113, to which it is joined perimetrically, an upper assembly to be associated in an upper region with the outsole 111.

Advantageously, the structural insert 112 comprises a functional layer 119 that is impermeable to water and permeable to water vapor. The functional layer 119 can constitute entirely the structural insert 112 or, as shown, can be coupled to an insole 120.

The functional layer 119 is joined to the upper 113 by means of a stitched seam 121, of the Strobel type, and the two are sealed by means of a thermo-adhesive waterproof tape 122, substantially a film of thermoplastic hot-melt adhesive, made of polyurethane, polyester, polyamide or polyolefins, which can be activated by subjecting it to heat and pressure. Such film, heated and subjected to pressing, softens and penetrates the permeable substrates to be sealed, onto which it is pressed. Then, by cooling, it establishes a connection by adhesive bonding of a mechanical and chemical type with such substrates and reacquires its original strength.

The tape 122 is arranged so as to straddle the joint between the upper 113 and the functional layer 119, so as to be sealed to both.

According to this variation, the outsole 111 can be provided by direct injection on the upper 113, providing a hermetic joint between the functional layer 119 and the outsole 111. In this case, the breathable element 114, in a closed mold, is compressed by the lower walls of the mold, closing a large number of the channels between the granules and thus preventing the polymer that composes the outsole, for example polyurethane, from infiltrating between the channels, blocking them. Upon opening the mold, the compression on the channels is released, returning them substantially to the initial size.

With reference to FIGS. 8 to 11, the shoe according to the invention is designated generally by the reference numeral 210 in its third embodiment.

Like the preceding embodiments, it comprises an outsole 211 that is arranged below a structural insert 212, which is at least partially breathable, and below an upper 213.

The outsole 211 is at least partially breathable, comprising a sheet-like breathable element 214 that is defined by a plurality of granules 215 made of expanded material and having a uniform size, which are arranged in a substantially ordered manner and between which there are voids which form one or more channels through the breathable element 214 which are permeable to air and/or vapor.

The granules 215 of the breathable element 214 are bonded by means of an adhesive, a water-based polyurethane glue, which is thermoplastic or thermosetting and preferably biodegradable and/or recyclable. The glue, by wrapping around the granules, allows their adhesion, leaving gaps between them. The gaps are mutually connected, creating the channels for the transit of air.

The arrangement of the granules 215 is ordered when their succession repeats periodically, in one or more directions, along the part. In particular, arrangements known from crystalline lattices of metals, salts and minerals are preferred. Furthermore, since the granules 215 have a uniform size, they are arranged in an ordered manner at least with respect to the planes that contain them. They have a substantially spherical shape, facilitating an at least almost ideal arrangement of the particles, such as the hexagonal or cubic packing in metals.

In this embodiment also, it is possible to use a breathable element in the variations shown in FIGS. 12 to 15 for the breathable element 14.

The outsole 211 also comprises a midsole 216 and a tread 217 that is associated in a lower region with the midsole 216.

In particular, the shoe 210 comprises an upper assembly, which is defined by the perimetric joining of an insole 220 with the upper 213, and the outsole 211, which in turn comprises the breathable element 214 with which the upper assembly is associated in an upper region and a tread 217 for contact with the ground is associated in a lower region, the midsole 216 being constituted by the breathable element 214.

The breathable element 214 thus covers the entire sole of the foot and can be wrapped in fabric, leather or other breathable material.

Figure 8:
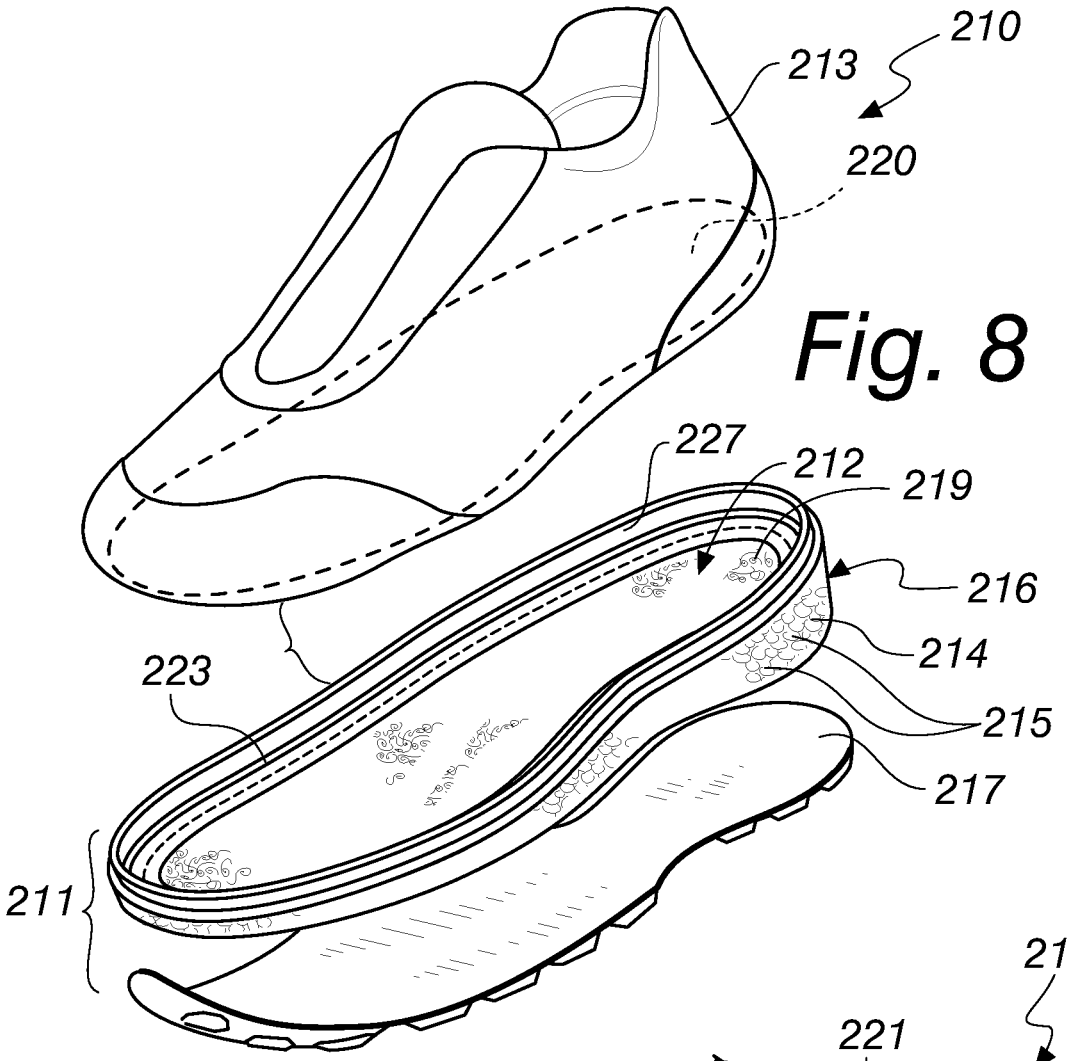
FIG. 8 is a partially exploded perspective view of a shoe according to the invention in a third embodiment.
Figure 9:
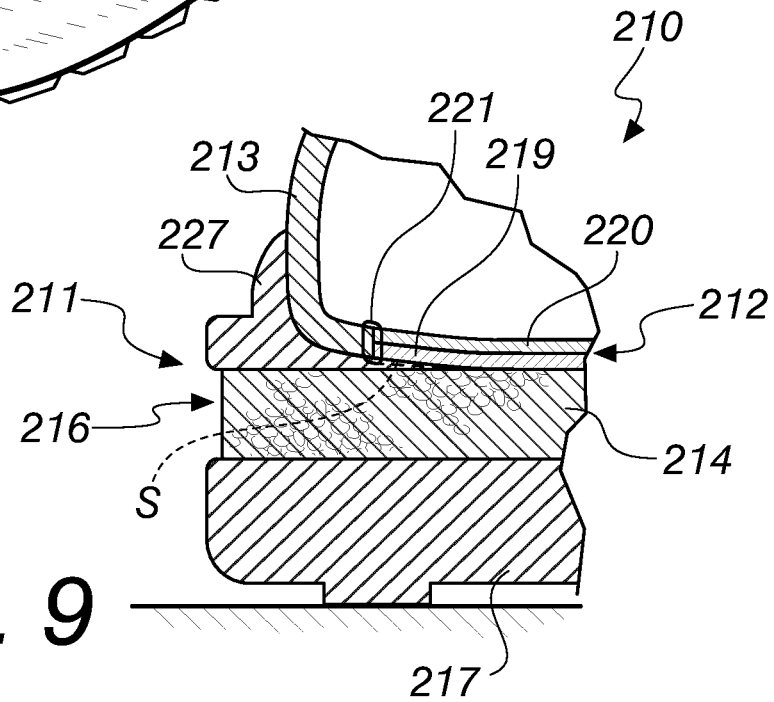
FIG. 9 is a sectional view of a portion of the shoe according to the invention in a variation of the third embodiment.

In the variations of FIG. 8 and FIG. 9, the outsole 211 comprises a waterproof perimetric element 227 that is structured like a welt between the midsole 216 and the upper 213.

In the variation of FIG. 8, the structural insert 212 is arranged within the internal perimeter defined by the waterproof perimetric element 227 that is structured like a welt.

It comprises a waterproof and breathable functional layer 219, which is arranged above the breathable element 214. The functional layer 219 can be of the same type described for the preceding embodiment.

The functional layer 219 is joined hermetically to the outsole 211. In particular, it is joined hermetically to the waterproof perimetric element 227 that is structured like a welt (above its internal perimeter), by means of a ring 223 made of waterproof material (for example PVC) that is applied like a bridge between the two elements.

In the variation shown with the sectional view of FIG. 9, the structural insert 212, which is structured like an assembly insole, comprises a functional layer 219 and an insole 220, which are joined perimetrically to the upper 213, forming an upper assembly. The structural insert 212 is superimposed on the breathable element 214 and on the internal perimeter of the waterproof perimetric element 227, and is joined to the upper 213 by means of a stitched seam 221 of the Strobel type.

The functional layer 219 and the upper 213 are joined hermetically to the waterproof perimetric element 227 (above its internal perimeter), preferably at the functional layer 219, along a sealing margin, for example by means of adhesives, below the stitched seam 221 for a width that is designated by the reference S and is shown in broken lines and can vary preferably between 5 mm and 10 mm.

In an alternative version, not shown, the waterproof perimetric element structured like a welt can be replaced by a film of hot-melt material (for example TPU) which is applied perimetrically on the upper surface of the midsole by hot thermal bonding: according to this variation, costs are reduced with respect to the use of a waterproof permeable element structured like a welt. In this version, the functional layer and the upper are sealed to the film along a sealing margin, for example by means of adhesives.

Figure 10:
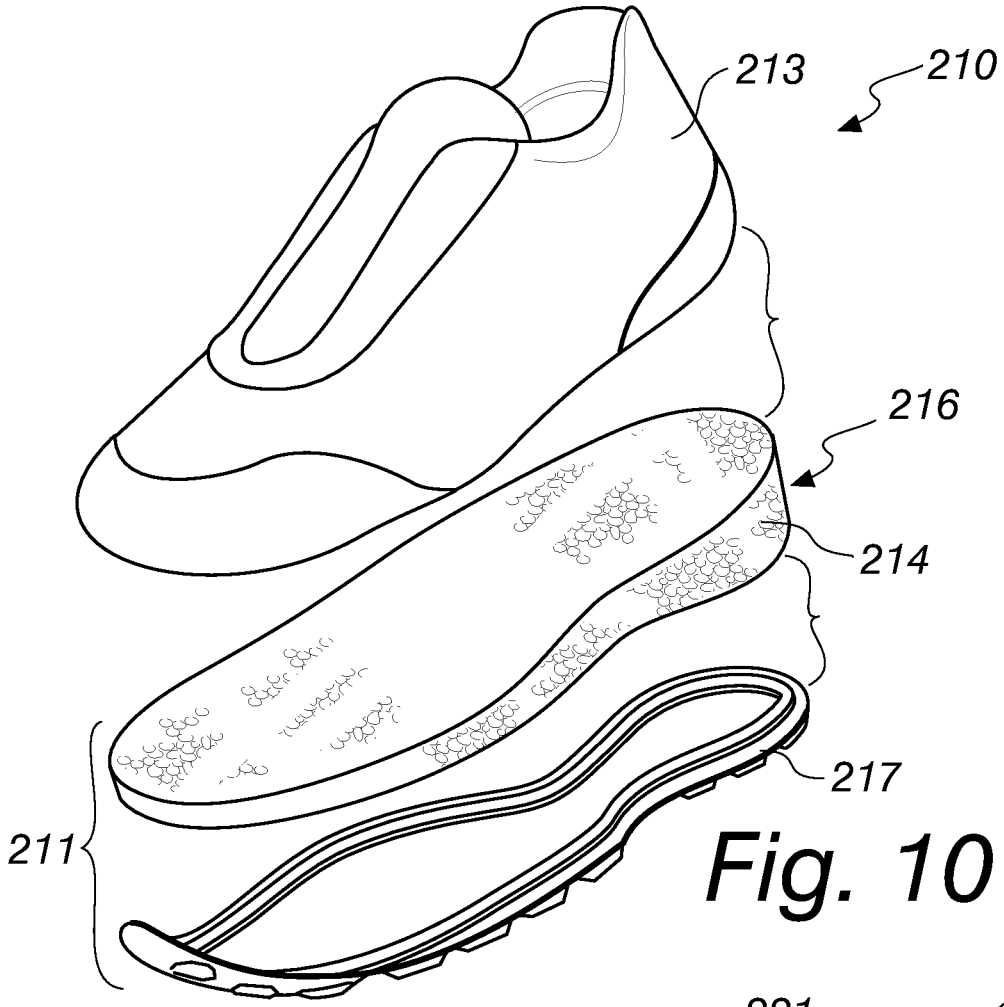
FIG. 10 is a partially exploded perspective view of a shoe according to the invention in another variation of the third embodiment.
Figure 11:
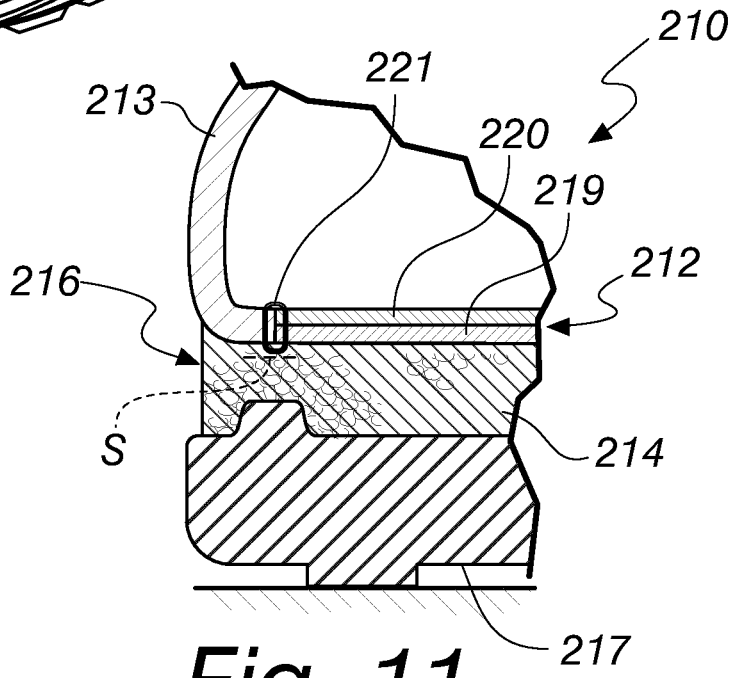
FIG. 11 is a sectional view of a portion of the shoe according to the invention in the variation of FIG. 10.

According to the variation shown in FIG. 10 and in FIG. 11, the structural insert 212 comprises a functional layer 219 and an insole 220, which when joined perimetrically to the upper 213 define an upper assembly to be associated above the outsole 211 and the latter in turn comprises a breathable element 214 with which the upper assembly is associated in an upper region and the tread 217 is associated in a lower region. The outsole 211 comprises a mid-sole 216, which is constituted by the breathable element 214, and with respect to the preceding version does not have the waterproof perimetric element structured like a welt.

As can be seen from the cross-section of FIG. 11, the structural insert 212 comprises a functional layer 219 that is coupled to an insole 220, but as an alternative it can be constituted entirely by a functional layer. It is joined by means of a stitched seam 221 of the Strobel type to the upper 213 and the two are sealed along a sealing surface below the stitched seam 221 for a width designated by the reference S and shown in broken lines.

In particular, the breathable element 214 is arranged between the tread 217 and the upper assembly and the sealing surface is provided on its surface by means of a process for example of thermoforming, which within a perimetric area of the breathable element 214 closes the channels between the granules, making the surface suitable to bond, creating a seal that is impermeable to liquids on the functional layer 219.

The functional layer 219 is joined hermetically to the upper surface of the breathable element 214, advantageously by means of the same thermoplastic adhesive with which the granules 215 are bonded, the breathable element 214 being subjected to thermoforming at the sealing surface.

In this manner it is not necessary to resort to the waterproof perimetric element structured like a welt, containing production costs.

Thermoforming, by closing the channels between the granules, reduces considerably lateral vapor permeation through the breathable element 214, and therefore in this variation it is preferable to use a perforated tread.

In order to ensure the closure of the channels between the granules, the midsole 216, therefore the breathable element 214, has a reduction of its thickness, as can be seen in the sectional view of FIG. 11, for a width S that corresponds to the sealing surface, where the highest pressure occurs locally during the thermoforming process.

In all of the described embodiments, the breathable element 14, 114 or 214 can be obtained advantageously by blanking and/or thermoforming, starting from a sheet-like element provided by means of a continuous production process.

The term "sheet-like" is understood to reference the shape characteristic of a structure that has one dimension that is greatly reduced with respect to the other two, such dimension being its thickness, which in any case, according to what is commonly understood to differentiate a sheet from a lamina or a membrane, remains significant. However, it should not be understood that this shape characteristic per se compromises the ability to curve or flex.

The granules are provided by means of expanded polymers, preferably thermoplastic ones.

According to a preferred variation, the polymers can be chosen among polyethylene, ethylene vinyl acetate, thermoplastic elastomers based on copolymers with styrene blocks, thermoplastic elastomers with a urethane base, thermoplastic elastomers based on polyesters or co-polyesters, and preferably from a mixture comprising at least ethylene vinyl acetate or polyethylene and mixtures thereof or ethylene-propylene rubber and in addition block copolymers of the styrene-ethylene-propylene-styrene or styrene-ethylene-butylene-styrene type.

In another preferred variation, the expanded polymers comprise an elastomeric biodegradable polymeric composition with hardness characteristics from 50 Shore A to 65 Shore D and comprising:

15% to 50% by weight of a thermoplastic urethane polyester with a hardness from 50 to 90 Shore A, 35% to 75% by weight of a copolyester with a hardness between 32 and 70 Shore D, 5% to 40% by weight of a non-phthalic plasticizer.

The plate can be obtained by sintering of the granules, which occurs substantially in two steps: a first step, in which the already expanded granules are covered with a thermoplastic adhesive, and a second step of surface softening of the granules and activation of the thermoplastic adhesive in order to mutually bond the granules.

In particular, in the continuous production process, the granules covered with adhesive are distributed on a conveyor belt continuously, so as to obtain an arrangement of the granules with compact packing (preferably with a packing density of more than 0.7 in the case of a two-dimensional arrangement and greater than 0.6 in the case of a three-dimensional arrangement) and the adhesive is activated in order to connect the granules.

The packing density corresponds to the quotient between the volume occupied by the particles and the total volume composed of the volume occupied by the particles and the volume occupied by the gaps. In the case of a two-dimensional arrangement, this density corresponds to the quotient between the area occupied by the particles and the total area.

The conveyor belt is preferably provided with longitudinal shoulders along the edges in order to contain the granules. The shoulders are useful to create a high compactness and uniformity in the arrangement of the particles and also allow to determine a predefined width of the sheet.

As anticipated, the granules are substantially spherical. In particular, they have substantially identical dimensions and a diameter preferably comprised between 3 mm and 9 mm.

The substantially spherical shape of the granules and the substantially uniform dimensions facilitate an at least partially regular packing. Maximum packing is substantially regular as a cubic or hexagonal compact packing or also a mixed cubic-hexagonal compact packing, which have a density of 0.74.

The compact and regular arrangement of the granules ensures a more uniform distribution of the gaps and consequently a more uniform breathability of the breathable element.

The softening step has a particularity in that it occurs at a temperature below 100° C., contributing to contain process costs with respect to steam processes of the background art, considering that steam generation occurs at temperatures higher than 100° C.

As an alternative, in all the embodiments of a shoe according to the invention, the granules (again made of expanded material and having uniform dimensions) of the breathable element are mixed with an adhesive and superimposed on a layer of mesh 31, made of hydrophobic material, which is capable of drying rapidly and is preferably resistant to piercing.

It can be provided preferably by means of a polyester monofilament.

Such breathable element can be arranged in the shoe with the mesh layer directed upwardly.

As in the preceding case, it can be obtained by blanking and/or thermoforming, starting from a sheet-like element.

The latter can be provided by pouring continuously the granules, mixed with an adhesive, onto the mesh layer.

It is advantageously possible to provide, on the mesh layer, strips of glue that can be reactivated by heating in order to improve the adhesion between the mesh layer and the granules.

A system of rollers or heating plates thermoforms both sides of the sheet thus obtained, in which, as in the preceding version, the granules made of expanded material are arranged in a substantially ordered manner and between them there are voids which form one or more channels through said breathable element which are permeable to air and/or vapor.

Operation of the shoe according to the invention is evident from what has been described and illustrated and in particular it is evident that the humid air that arrives from the inside of the shoe can be expelled into the external environment, passing in succession through the functional layer and the channels of the breathable element, to then exit from such breathable element toward the outside, at the lower through openings or at the lateral openings or in any lateral point in the case of the first variations of the third described embodiment.

Vapor permeation is ensured by the use of an adhesive which, by wrapping around the granules, allows the transit of the air through the breathable element, and by the ordered arrangement of the granules, which generates a substantially ordered distribution of the voids that are present between them and therefore clearly defined channels.

Furthermore, the uniform dimension of the granules entails an increase in the overall porosity and consequently in the air comprised between the granules: the thermal insulation capacity therefore increases and, especially for countries characterized by cold climates, is not compromised by the openings and perforations of the outsole that are necessary in order to ensure breathability.

It should also be noted that, as described and illustrated for the second embodiment of the shoe 110 according to the invention, the use of two portions of breathable element, 114*a* and 114*b*, allows to avoid, after blanking and/or thermoforming, an additional shaping of the side walls of the breathable element, for example by roughing, which might cause the separation of some granules, increasing rejects.

In practice it has been found that the invention achieves the intended aim and objects in providing a breathable shoe with adequate levels of comfort for the user, ensuring breathability by means of clearly defined channels and at the same time light weight and shock-absorbing capabilities, which are inherent characteristics of the expanded material.

Furthermore, despite using an element constituted by granules made of expanded material, it is possible to contain the overall production costs of the shoe according to the invention thanks to the possibility to use sheet-like semifinished products which can be brought by blanking to the desired shape and size, avoiding their production in molds, which would have to be designed for each model and size of the shoe.

Another advantage of the shoe according to the invention resides in that the structure of the breathable element, which is substantially three-dimensional and provided with channels, allows vapor permeation both in a direction that is substantially perpendicular to the sole of the foot, when through openings on the tread are present, and in a transverse direction, for example by means of adapted lateral openings, allowing in this last case the use of treads that are not perforated.

The invention thus conceived is susceptible of numerous modifications and variations, all of which are within the scope of the appended claims; all the details may further be replaced with other technically equivalent elements.

In practice, the materials used, so long as they are compatible with the specific use, as well as the contingent shapes and dimensions, may be any according to requirements and to the state of the art.

The disclosures in Italian Patent Application No. 102015000048836 (UB2015A003437) from which this application claims priority are incorporated herein by reference.

The invention claimed is:

1. A breathable shoe, comprising:

an upper;

a structural insert that is at least partially breathable; and an outsole arranged below the structural insert and below the upper, wherein the outsole is at least partially breathable, and includes at least one sheet-like breathable element defined by a plurality of granules made of expanded material and having a uniform size, and wherein the plurality of granules are arranged in an ordered manner and between the plurality of granules there are voids that form one or more channels through the breathable element that are permeable to air and/or vapor.

2. The shoe according to claim 1, wherein the granules of the breathable element are bonded by an adhesive.

3. The shoe according to claim 1, wherein the structural insert comprises a waterproof and breathable functional layer.

4. The shoe according to claim 3, wherein the functional layer is joined hermetically to the upper surface of the midsole.

5. The shoe according to claim 3, wherein the waterproof and breathable functional layer is joined hermetically to the outsole.

6. The shoe according to claim 1, wherein the structural insert constitutes, with the upper to which it is joined perimetrically, an upper assembly to be associated in an upper region with respect to the outsole.

7. The shoe according to claim 1, wherein the outsole comprises:

a midsole including at least one through opening in a plantar region, which is occupied by the at least one breathable element, on which the structural insert is superimposed, a tread associated in a lower region with the midsole to cover partially the breathable element, including through openings at least at the breathable element.

8. The shoe according to claim 1, wherein the outsole comprises a cavity in a plantar region, which is occupied by at least one the breathable element on which the structural insert is superimposed and lateral openings, on at least one side of the shoe, which are faced by the breathable element, and the outsole comprises a tread for contact with the ground, to cover the breathable element at least partially.

9. The shoe according to claim 8, wherein the breathable element includes at least two portions of:

a first breathable element portion that includes at least one slit provided substantially in the longitudinal direction of the shoe, at least one second breathable element portion that when inserted in the slit widens it, occupying space thereof between its walls.

10. The shoe according to claim 1, further comprising:

an upper assembly, defined by a perimetric joining of at least one insole with the upper, the outsole, which comprises at least one the breathable element, with which the upper assembly is associated in an upper region and a tread is associated in a lower region.

11. The shoe according to claim 10, wherein the outsole comprises a midsole constituted by the at least one breathable element.

12. The shoe according to claim 11, wherein the outsole comprises a waterproof perimetric element between the midsole and the upper.

13. The shoe according to claim 12, wherein a functional layer is joined hermetically to the waterproof perimetric element.

14. The shoe according to claim 10, wherein a functional layer is joined hermetically to the upper surface of the breathable element by a thermoplastic adhesive with which the granules are bonded, the breathable element being subjected to thermoforming at a sealing surface.

15. A breathable shoe, comprising:

an upper;

a structural insert that is at least partially breathable; and an outsole arranged below the structural insert and below the upper, wherein the outsole is at least partially breathable and includes at least one sheet-like breathable element defined by a plurality of granules made of expanded material and having a uniform size, wherein the plurality of granules are arranged in an ordered manner and between the plurality of granules there are voids that form one or more channels through the breathable element that are permeable to air and/or vapor, and wherein the granules of the breathable element are bonded by an adhesive.

* * * * *